United States Patent [19]

Yeh

[11] Patent Number: 4,938,388

[45] Date of Patent: Jul. 3, 1990

[54] GLUE TRANSPORT MECHANISM FOR A MOLTEN GLUE DISCHARGING DEVICE

[75] Inventor: Chao Bin Yeh, Taipei, Taiwan

[73] Assignee: Future Co., Ltd., Taipei, Taiwan

[21] Appl. No.: 347,870

[22] Filed: May 5, 1989

[51] Int. Cl.[5] ..... B67D 5/62; B05G 5/04

[52] U.S. Cl. ..... 222/146.5; 219/241; 226/127; 226/187; 401/2

[58] Field of Search ..... 401/1-3; 222/146.2, 146.5; 226/186, 187, 181, 127; 219/241

[56] References Cited

U.S. PATENT DOCUMENTS

| | | | |
|---|---|---|---|
| 1,449,517 | 3/1923 | Lame | 401/2 |
| 2,742,142 | 4/1956 | Paulsen | 226/127 |
| 3,232,509 | 2/1966 | Newton | 226/127 |
| 3,443,059 | 5/1969 | Spencer | 401/2 |
| 4,032,046 | 6/1977 | Elliott | 401/1 |
| 4,059,204 | 11/1977 | Duncan | 222/146.5 |
| 4,621,748 | 11/1986 | Dziki | 226/127 |

*Primary Examiner*—Richard J. Johnson

*Attorney, Agent, or Firm*—Fleit, Jacobson, Cohn, Price, Holman & Stern

[57] ABSTRACT

A glue transporting mechanism for a molten glue discharging device essentially comprising a heating element, a transporting tube and a gear to move the introduced glue strip such that the heating element means the strip and the melted glue is delivered through the tube.

6 Claims, 4 Drawing Sheets

GLUE TRANSPORT MECHANISM FOR A MOLTEN GLUE DISCHARGING DEVICE

BACKGROUND OF THE INVENTION

The use of a molten glue discharging device in gun form is very popular. Currently, the available glue gun requires the use of both of the operator's hands. One hand is used to push-feed the solid glue strip the other hand is needed to press down with the device. As a result, pressure must be maintained on the device if the glue strip is of high melting point. Therefore, it is not only troublesome, but also the hands may be hurt. Further, if the glue strip is continuously pushed, the heating means of the device may not be able to melt the glue strip or stick in time or if the pushing force on the glue strip is released, the melted glue may flow backward and jam the discharging device.

SUMMARY OF THE INVENTION

It is an object of the present invention to provide a glue feeding mechanism for a glue discharging device including a pressure roller to advance the glue strip.

It is a further object of the present invention to provide a glue feeding mechanism which is lightweight and simple to construct.

It is another object of the present invention to provide a glue feeding mechanism which may be readily assembled and produced at a very low cost.

These, and other objects and advantages of the present invention, will become more apparent from a consideration of the following detailed description of the preferred embodiments, when read in conjunction with the accompanying drawings.

DETAILED DESCRIPTION OF THE PREFERRED EMBODIMENT

Figure 1:
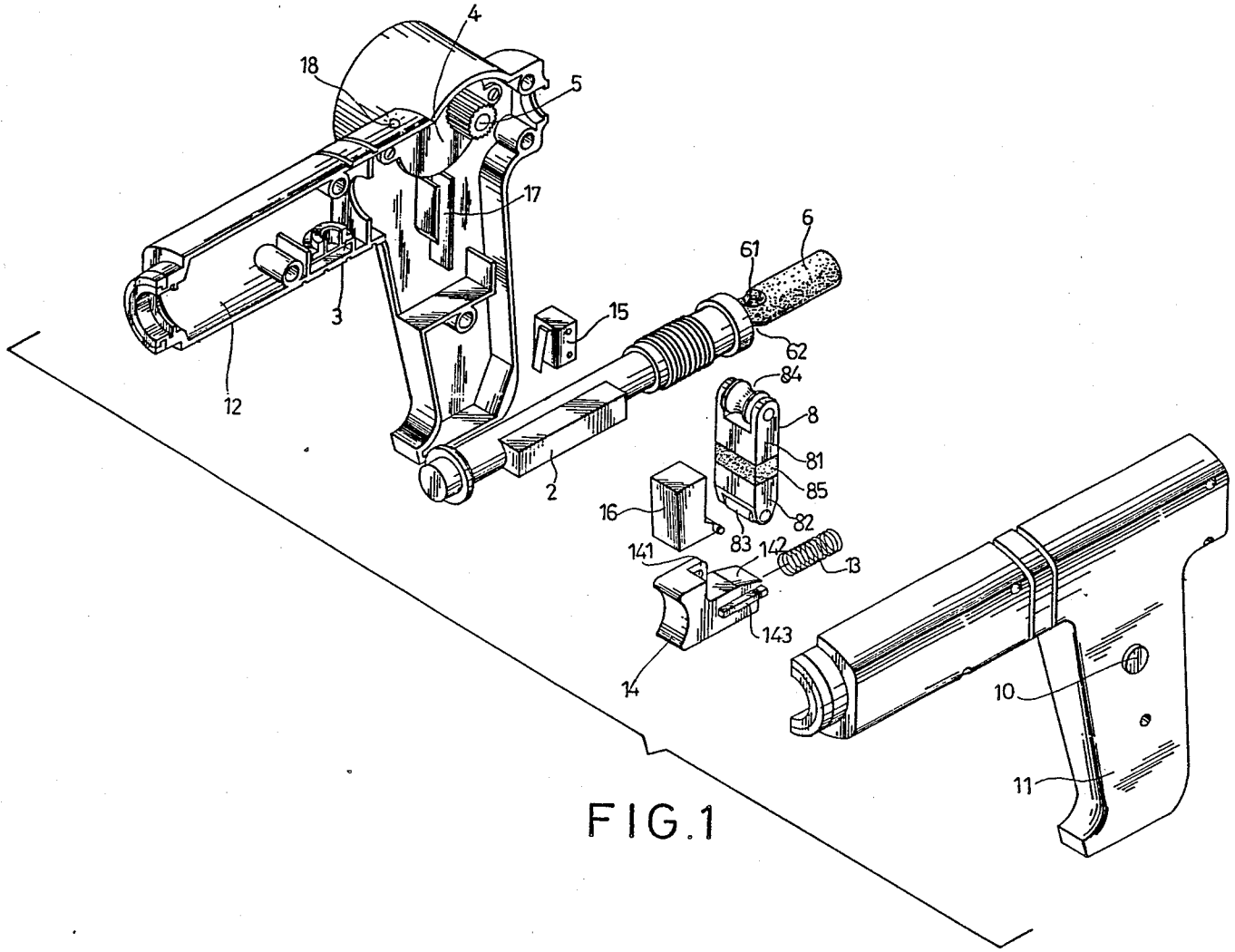
FIG. 1 is an exploded perspective view of the glue gun illustrating the feeding mechanism for a glue strip, according to the present invention.
Figure 2:
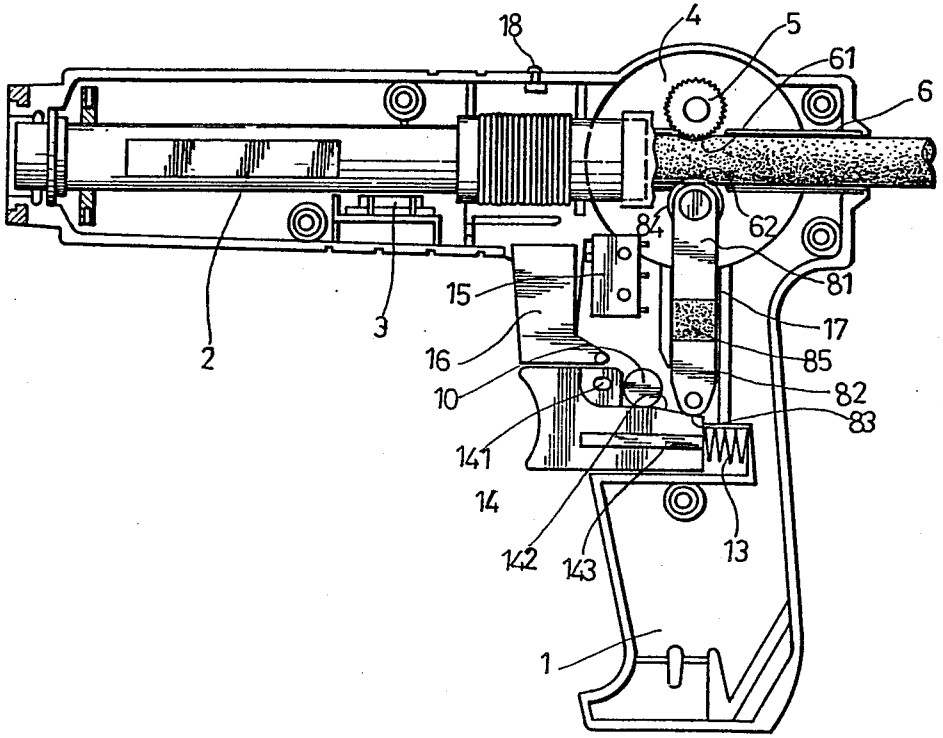
FIG. 2 is a side elevational view of the glue gun with the nearside housing half removed.
Figure 4:
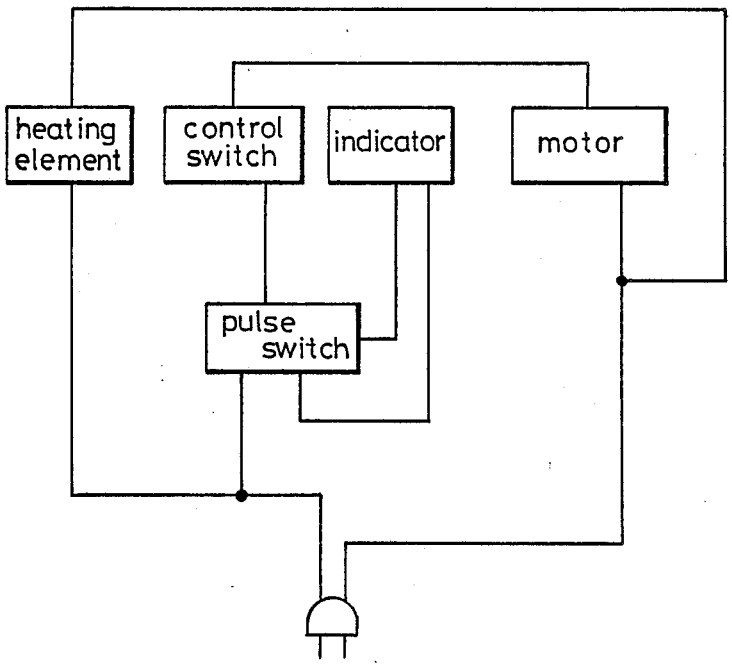
FIG. 4 is a circuit block diagram of the present invention.

Referring now to FIGS. 1 and 2, an exemplary preferred embodiment of a glue discharging device or gun 1 incorporates a heating element 2 (of which the control circuit is illustrated in FIG. 4) mounted above a temperature control switch 3 and a conduit or guide tube 6 including upper and lower notches 61 and 62.

Two shells 11 and 12 form a housing of the glue gun 1. An indicator lamp 18 and a servo-motor 4 are mounted on the left shell 12. A gear 5 is mounted on the revolving shaft of the servo-motor 4. A pressure wheel set 8 is slidably received in a channel 17 defined in the housing of the glue gun 1. The pressure wheel set 8 includes upper and lower ends 81 and 82 with a resilient rubber connector 85 connected therebetween, a pressure wheel 84 being rotably mounted from the upper end 81 and a face wheel 83 being rotably mounted from the lower end 82.

A trigger 14 is mounted on the housing 11, 12 of the glue gun 1, which incorporates a track 143 for sliding in a slide way (not shown) inside the housing shell 11 of the glue gun 1 and an opening 141 is provided in the trigger 14 for receiving therein a lock pin 10 slidably mounted from the housing shell 11 of the gun 1. The trigger 14 includes a slope or ramp surface 142 on its rear end and a compression spring 13 yieldingly biases the trigger 14 forward. When the trigger 14 is in its forwardmost position illustrated in FIG. 2, the pressure wheel set 8 is allowed to assume its lowermost position with the pressure wheel 84 thereof spaced below the gear 5 sufficiently to be unable to clamp the glue stick within the guide tube 6 between the pressure wheel 84 and the gear 5. Also, a pivoted block 16 disposed immediately above the trigger 14 is cammed into its uppermost position opening the micro switch 15 disposed intermediate the block 16 and the pressure wheel set 8 and mounted from the housing shell 11.

Referring to FIG. 2, during the assembly, the heating element 2 is mounted on the outer wall of the glue stick guide tube 6 at a front part thereof. The glue stick guide tube 6 is positioned within the left shell 12 of the glue gun 1 with the upper notch 61 disposed in position for receiving the gear 5 of the servo-motor 4 therethrough and with the bottom notch 62 of the guide tube 6 disposed above and receiving the pressure wheel 8 therethrough. The trigger 14 is placed in the housing with its track 143 set in the slide way (not shown) of the housing and the block 16 is pivotally mounted from the left shell 12. Thereafter, the right shell 11 is mounted on the left shell 12 to enclose all of the internal parts of the gun 1.

Figure 3:
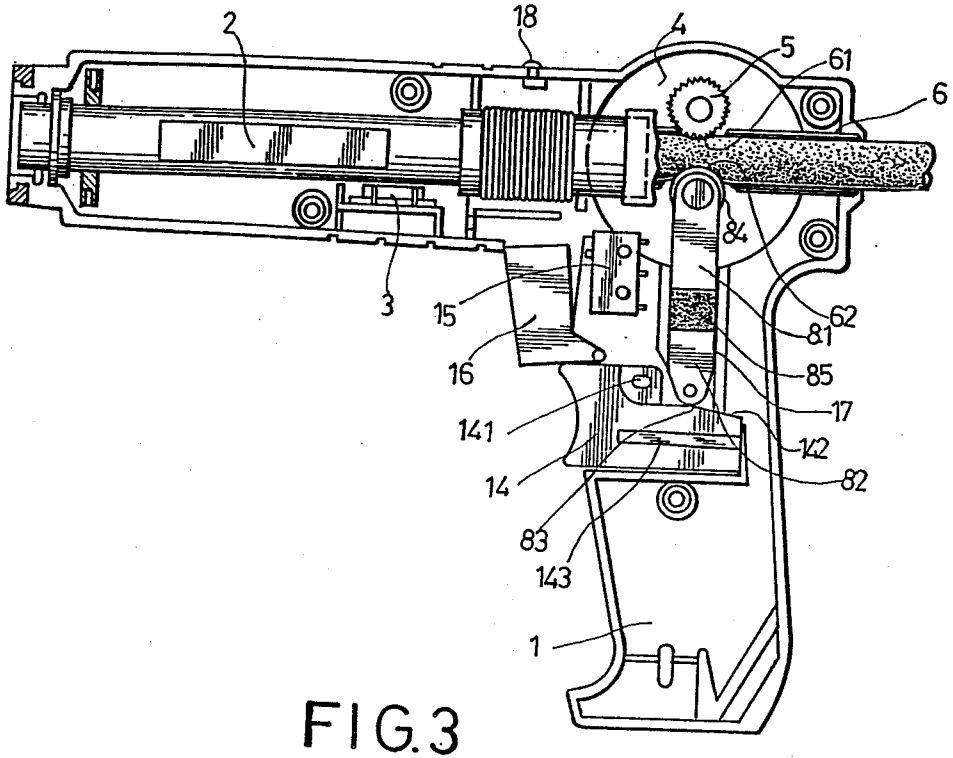
FIG. 3 is an elevational view similar to FIG. 2 illustrating the feeding mechanism for the glue strip in operational condition.

With reference made to FIGS. 3 and 4, electrical power is initially connected to the circuit diagram of FIG. 4 in order to electrically actuate the heating element 2. As soon as the heating element 2 is heated to a temperature above the melting point of the associated glue stick, the indicator lamp 18 is actuated. Thereafter, the trigger 14 is pulled rearwardly to the position thereof illustrated in FIG. 3 and the lock pin 10 is displaced inwardly to engage in the opening 141 of the trigger 14 so as to releasably lock the trigger 14 in its rearmost position. As the trigger 14 is moved to the rearmost position thereof illustrated in FIG. 3, the pressure wheel set 8 is upwardly displaced by the ramp 142 of the trigger 14 to clamp the glue stick disposed within the guide tube 6 between the clamp wheel 84 and the gear 5, the resilient rubber connector 85 serving to maintain and control the clamping force of the pressure wheel 84 and gear 5 on the associated glue stick.

As the trigger 14 was displaced rearwardly, the block 16 is allowed to pivot forwardly and downwardly to thus close the micro switch 15 comprising the control switch for the motor 4 and the motor 4 is thus actuated to cause the gear 5 to be rotated and the glue stick disposed within the guide tube 6 to be strongly urged forwardly in the guide tube.

After a gluing operation is completed, the trigger 14 is urged slightly rearwardly to release the lock pin 10 and thereafter released to allow the trigger 14 to shift from the rearmost position thereof illustrated in FIG. 3 to the forward most position thereof illustrated in FIG. 2. This allows the wheel set 8 to drop downward by gravity and causes the block 16 to pivot upwardly and rearwardly to thereby open the micro switch 15. This of course terminates operation of the motor 4.

I claim:

1. An electric glue gun, including:

a housing;

A glue stick guide tube having front and rear ends disposed in said housing for receiving a glue stick therein, said glue stick guide tube incorporating an upper notch and a lower notch opening thereinto;

an electric heating element externally mounted on said glue stick guide tube adjacent the front end thereof;

a servo-motor mounted in said housing and including a rotary driven gear, said gear projecting through said upper notch of said glue stick guide tube to drive a glue stick disposed therein and to move said glue stick forward in said guide tube for melting by said electric heating element;

a pressure wheel set mounted for up and down shifting within said housing and including an upper end from which a pressure wheel is journalled projecting into said lower notch and a lower end, a trigger shiftably mounted from said housing for movement between on and off positions, said trigger and said lower end including co-acting means for upwardly displacing said pressure wheel set relative to said housing responsive to movement of said trigger toward said on position;

a motor controlling switch mounted in said housing for controlling operation of said servo-motor; and an operator shiftably supported from said housing and operatively associated with said trigger and motor controlling switch for closing the latter responsive to shifting of said trigger to said on position.

2. An electric glue gun according to claim 1 including a main electrical circuit in which said heating element is serially connected, a second loop circuit connected in parallel with said main circuit, said control switch being serially connected in said loop circuit, and a normally open temperature control switch serially connected in said loop circuit and responsive to sensing of sufficient heat generated by said electric heating element to melt a glue stick for closing said temperature control switch.

3. The electric glue gun of claim 1 wherein said upper and lower ends of said pressure wheel set are spaced apart and interconnected by a resilient connecting body.

4. The electric glue gun of claim 1 wherein said trigger includes a cammed surface thereon with which the lower end of said pressure wheel set is engaged and operative to upwardly displace said pressure wheel set responsive to movement of said trigger to the on position, said trigger and housing including lock means operative to releasably lock said trigger in the on position.

5. The electric glue gun of claim 4 including means yieldingly biasing said trigger to said off position.

6. The electric glue gun of claim 4 wherein said upper and lower ends of said pressure wheel set are spaced apart and interconnected by a resilient connecting body.

* * * * *